United States Patent [19]

Yasuda et al.

[11] Patent Number: 4,767,898

[45] Date of Patent: Aug. 30, 1988

[54] PRESSURE RESPONSIVE SWITCH WITH AN AIR FILTER

[75] Inventors: Keiji Yasuda, Handa; Yukihisa Oda, Chiryu, both of Japan

[73] Assignee: Aisin Seiki Kabushiki Kaisha, Kariya, Japan

[21] Appl. No.: 78,624

[22] Filed: Jul. 28, 1987

[30] Foreign Application Priority Data

Jul. 29, 1986 [JP] Japan ..... 61-116127[U]

[51] Int. Cl.[4] ..... H01H 35/34

[52] U.S. Cl. ..... 200/83 R; 92/78; 200/83 N; 200/83 S; 200/302.1

[58] Field of Search ..... 340/626; 73/706, 723, 73/756; 60/547.1; 91/1, 376, 369; 200/81 R, 83 R, 83 N, 83 J, 83 S, 83 W, 302, 303; 92/78

[56] References Cited

U.S. PATENT DOCUMENTS

| | | | |
|---|---|---|---|
| 3,917,917 | 11/1975 | Murata | 200/83 N |
| 4,215,254 | 7/1980 | Ohki | 200/83 J |
| 4,267,766 | 5/1981 | Horsting | 91/369 C |
| 4,330,695 | 5/1982 | Poling | 200/83 S |
| 4,368,366 | 1/1983 | Kitamura | 200/83 J |

*Primary Examiner*—G. P. Tolin

*Attorney, Agent, or Firm*—Sughrue, Mion, Zinn, Macpeak, and Seas

[57] ABSTRACT

A pressure switch comprising a housing, a diaphragm that divides the inside of the housing into a pressure chamber and an atmospheric chamber, a switch portion mounted in the atmospheric chamber, and a resilient cap fitted over the housing. A porous filter is held between the housing and the cap. The diaphragm is actuated according to the difference between the pressures inside the chambers. The switch portion consists of a movable contact and a fixed contact, and is connected to terminals.

4 Claims, 4 Drawing Sheets

FIG. 1
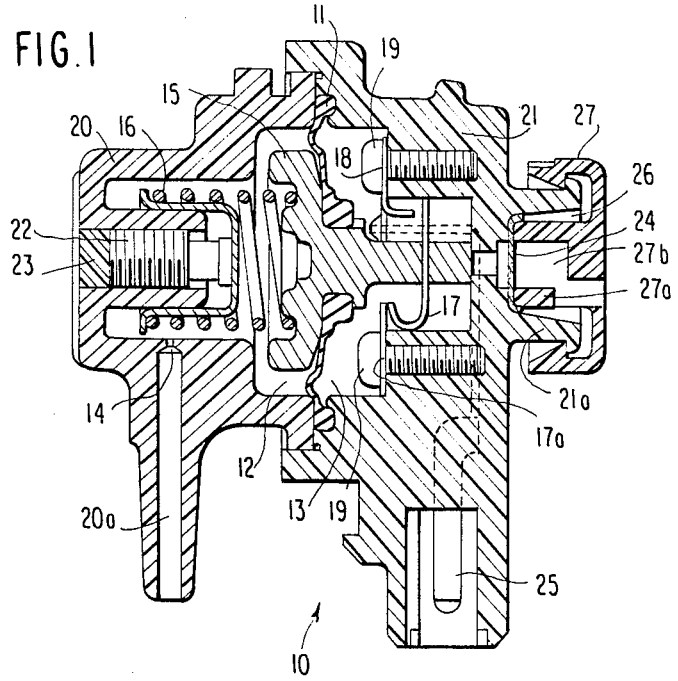
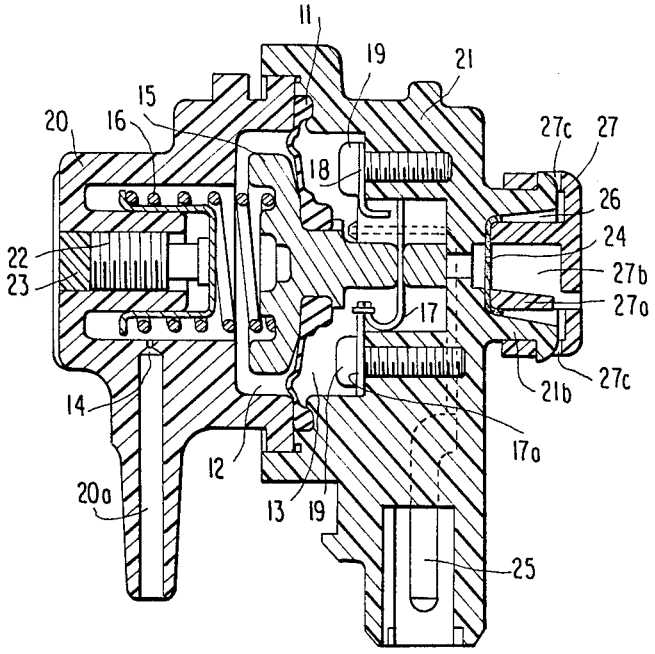
FIG. 2

FIG. 3
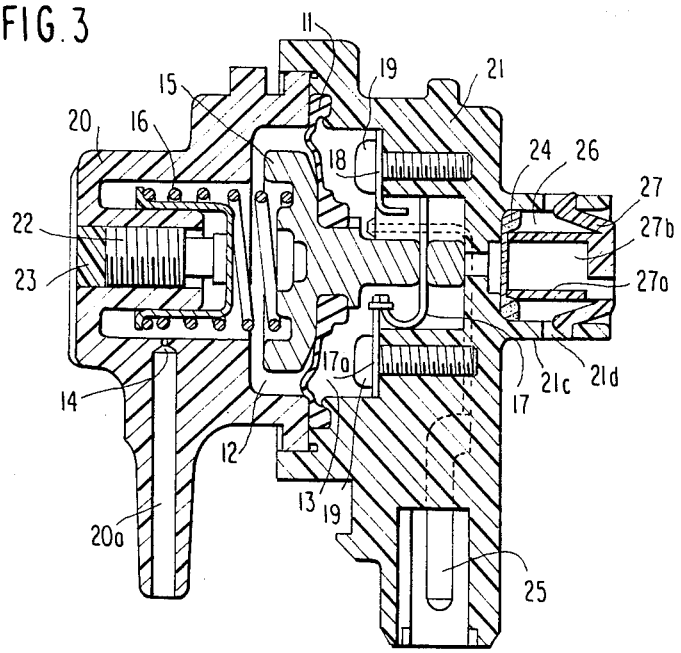
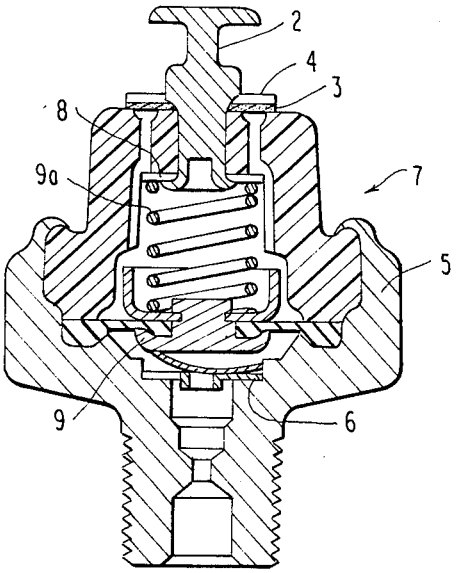
FIG. 4
PRIOR ART

PRESSURE RESPONSIVE SWITCH WITH AN AIR FILTER

FIELD OF THE INVENTION

The present invention relates to a pressure switch for connecting or disconnecting electrical contacts with each other according to a pressure applied to a port formed in the switch.

BACKGROUND OF THE INVENTION

A conventional pressure switch is disclosed in Japanese Utility Model Laid-Open No. 166,939/1985 and shown in FIG. 4, where the pressure switch is generally indicated by numeral 7. This switch 7 comprises an insulator 1 and a body 5. One fringe of the body 5 is totally crimped against the insulator 1 so that the body 5 is rigidly fixed to the insulator 1. A fixed contact 6 is mounted in the body 5 that is made of a metal. The fixed contact 6 is electrically and mechanically connected with the body 5.

The insulator 1 is made of an insulating material. A terminal 2 that is connected with a movable contact 9 has its one end portion crimped against the insulator 1. The terminal 2 is electrically connected with the movable contact 9 via a connecting plate 8 and a spring 9*a*. A porous filter 3 and a presser member 4 for pressing the filter 3 against the insulator 1 are interposed between the insulator 1 and the metallic terminal 2. This terminal 2 is crimped against the insulator 1.

When this pressure switch is assembled, if the terminal 2 is not sufficiently crimped, then the porous filter 3 cannot be sufficiently pressed against the insulator 1, creating a gap between the filter 3 and the insulator 1. If water or dust enters through this gap, the characteristics of the pressure switch may be impaired. For this reason, the components must be sized sufficiently accurately. Also, the crimping operations must be performed carefully. Therefore, much labor and a special crimping machine are required. As a result, the switch is manufactured inefficiently and expensively.

SUMMARY OF THE INVENTION

Accordingly, it is an object of the present invention to provide a pressure switch which can be manufactured efficiently and in which a porous filter is certainly held in position.

The above object is achieved by a pressure switch comprising a porous filter, a housing having a receiving portion in which the filter is mounted, a switch portion which is mounted in the housing and which is closed or opened according to a pressure applied from a pressure source, terminals electrically connected with the switch portion, and a resinous cap mounted in the receiving portion of the housing and having a passage for connecting the inside of the housing with the outside.

The housing and the resinous cap have claws for helping mount the cap fitly to the housing. Therefore, the pressure switch can be easily assembled without the need of a special crimping machine. The porous filter is held between the receiving portion of the housing and the presser portion of the cap. In this way, the novel switch is free of the foregoing drawbacks.

BRIEF DESCRIPTION OF THE DRAWINGS

FIG. 1 is a cross-sectional view of a pressure switch according to the invention;

FIG. 2 is a cross-sectional view of another pressure switch according to the invention;

FIG. 3 is a cross-sectional view of a further pressure switch according to the invention; and FIG. 4 is a cross-sectional view of a conventional pressure switch.

DETAILED DESCRIPTION OF THE INVENTION

FIGS. 1–3 show pressure switches according to the invention. The pressure switches are generally indicated by numeral 10. Each switch 10 comprises a resinous body 20 and a resinous housing 21. The inside of the switch 10 is divided into a pressure chamber 12 and an atmospheric chamber 13 by a diaphragm 11. The body 20 is provided with a port 20*a*. An orifice 14 extends from the bottom of the port 20*a*.

The pressure switch 10 is connected with a pressure source (not shown) via the port 20*a*. When a negative pressure is produced in this pressure source, the pressure inside the pressure chamber 12 becomes negative. Then, the pressure inside the pressure chamber 12 becomes lower than the pressure inside the atmospheric chamber 13. The resulting pressure difference urges the diaphragm 11 toward the pressure chamber 12. A pressure plate 15 mounted on the diaphragm 11 is forced toward the pressure chamber 12. Since the pressure plate 15 is always biased toward the atmospheric chamber 13 by a spring 16, as the pressure inside the pressure chamber 12 decreases, the pressure plate 15 gradually moves toward the pressure chamber 12. At this time, air flows into the atmospheric chamber 13 through a porous filter 24 which is permeable to air and water-repellent, to maintain the atmospheric pressure inside the atmospheric chamber 13.

One end of the spring 16 is so supported by an adjusting screw 22 that the force produced by the spring 16 can be adjusted. The screw 22 is made stationary by a mass of resin 23. The pressure plate 15 is provided with a groove (not shown) in which a movable contact 17 is fitted. One end of the movable contact 17 is always connected with a plate 17*a*, which is fixed to the housing 21 by a tapping screw 19. The movable contact 17 is bent like the letter "U"so that it has resilience.

When the pressure inside the pressure chamber 12 decreases and the pressure plate 15 moves a certain stroke toward the pressure chamber 12, the other end of the movable contact 17 is connected with a fixed contact 18, so that the pressure switch is closed. The fixed contact 18 and the plate 17*a* are connected to two electrically independent terminals 25. A harness is connected to the terminals 25 for connection with an external electical equipment.

Referring specifically to FIG. 1, the housing 21 has a cylindrical protruding portion 21*a* provided with a space 26 in its center. An outwardly protruding claw portion is formed at the front end of the protruding portion 21*a*. The porous filter 24 is mounted at the bottom of the space 26. A resinous cap 27 has a claw portion that is fitted over the claw portion of the protruding portion 21*a*, in order to make the filter 24 stationary. Since the claw portion of the resinous cap 27 resiliently deforms, it is easy to mount the cap 27 for fixing the filter 24. A cylindrical presser portion 27*a* for holding the filter 24 in place within the space 26 is formed integrally with the cap 27. Since the presser portion 27*a* holds down the whole outer periphery of the filter 24, no gap is created between the bottom of the housing 21 and the filter 24. The cap 27 is provided with a passage **27*b* to supply air into the atmospheric chamber 13**.

Referring next to FIG. 2, the housing 21 has a protruding portion **21*b* having a claw portion similar to the claw portion of the protruding portion 21*a* shown in FIG. 1. The cap 27 is provided with a hole 27*c* in which the claw portion of the protruding portion 21*b* is fitted. Since the cap 27 resiliently deforms and fits over the protruding portion 21*b*, the cap 27 can be easily mounted. The cap 27 has a presser portion 27*a* in its center to hold down the porous filter 24 within the space 26. The cap 27 is provided with a passage 27*b* to supply air into the atmospheric chamber 13**.

Referring next to FIG. 3, the housing 21 has a protruding portion **21*c* formed with a hole 21*d*. Radially outwardly protruding claws are formed on the cap 27 and fitted in the hole 21*d*. The cap 27 is mounted on the housing 21. Because the claws of the cap 27 resiliently deform, the cap 27 can be readily mounted. A presser portion 27*a* for holding down the porous filter 24 within the space 26 is formed in the center of the cap 27. The cap 27 has a passage 27*b* for drawing air into the atmospheric chamber 13**.

As can be understood from the description made thus far, the present invention provides a pressure switch comprising a porous filter, a resinous housing having a receiving portion in which the filter is mounted, a switch portion that is mounted in the housing and closed or opened according to a pressure applied from a pressure source, and terminals electrically connected with the switch portion. A resinous cap having a passage for connecting the inside of the housing with the outside is fitted in the receiving portion of the housing. The cap can be easily mounted to the housing without the need to accurately size the pressure switch. Also, the filter can be sufficiently fixed in position. Therefore, intrusion of water or dust can be prevented. Further, equipment such as a crimping machine is not needed. Consequently, the pressure switch can be manufactured inexpensively.

What is claimed is:

1. A pressure switch comprising a housing including a first portion, a second portion and diaphragm means secured between said first and second portions to define first and second chambers within said housing, said first housing portion having an air passage communicating said first chamber with the atmosphere and said second housing portion having an air passage for communicating said second chamber with a pressure source, position detecting means mounted in said first chamber for detecting the displacement of said diaphragm means, said first housing portion having a substantially cylindrical external projection surrounding said air passage therein, a porous filter disposed within said cylindrical projection and a resilient cap having resilient connecting means securing said cap to said cylindrical projection and an annular projection defining an air passage extending into said cylindrical projection on said first housing portion, said annular projection in resilient engagement with said porous filter about the entire periphery thereof whereby the peripheral portion of the filter is compressed to provide a seal while the central portion of the filter remains porous.

2. A pressure switch as set forth in claim 1 wherein said cylindrical projection is provided with outwardly protruding claw means and said resilient connecting means is comprised of complementary resilient claws for detachable connection with said claw means.

3. A pressure switch as set forth in claim 1 wherein said cylindrical projection is provided with outwardly protruding claw means and said resilient connection means is comprised a resilient skirt having apertures for receiving said claw means.

4. A pressure switch as set forth in claim 1 wherein said cylindrical projection is provided with a plurality of apertures and said resilient connection means is comprised of a plurality of complementary claws adapted to the engaged in said apertures.

* * * * *